US006336444B1

(12) United States Patent
Suder

(10) Patent No.: US 6,336,444 B1
(45) Date of Patent: Jan. 8, 2002

(54) DIESEL ENGINE FUEL INJECTION SYSTEM

(75) Inventor: Timothy Andrew Suder, Greencastle, PA (US)

(73) Assignee: Mack Trucks, Inc., Allentown, PA (US)

( * ) Notice: Subject to any disclaimer, the term of this patent is extended or adjusted under 35 U.S.C. 154(b) by 0 days.

(21) Appl. No.: 09/321,570

(22) Filed: May 28, 1999

(51) Int. Cl.[7] ..... F02M 37/04
(52) U.S. Cl. ..... 123/496; 123/506
(58) Field of Search ..... 123/496, 500, 123/501, 446, 458, 490, 506, 495, 514

(56) References Cited

U.S. PATENT DOCUMENTS

| | | | | | |
|---|---|---|---|---|---|
| 4,129,254 | A | * | 12/1978 | Bader, Jr. et al. | 239/96 |
| 4,509,487 | A | * | 4/1985 | Mowbray | 123/458 |
| 4,572,433 | A | * | 2/1986 | Deckard | 239/88 |
| 4,993,926 | A | * | 2/1991 | Cavanagh | 123/490 |
| 5,094,215 | A | * | 3/1992 | Gustafson | 123/500 |
| 5,271,366 | A | * | 12/1993 | Shimada et al. | 123/496 |
| 5,333,588 | A | * | 8/1994 | Cananagh | 123/506 |
| 5,619,969 | A | * | 4/1997 | Liu et al. | 123/496 |
| 5,803,049 | A | * | 9/1998 | Harcombe | 123/446 |
| 5,986,871 | A | * | 11/1999 | Forck et al. | 361/160 |

* cited by examiner

*Primary Examiner*—Henry C. Yuen
*Assistant Examiner*—Mahmoud Gimie
(74) *Attorney, Agent, or Firm*—Rothwell, Figg, Ernst & Manbeck

(57) ABSTRACT

A method and apparatus for rate shaping a fuel injection profile in a diesel engine. The system includes a fuel injector having a pump chamber, a fuel injecting plunger, a supply line, and a discharge nozzle. A rotation of a camshaft causes reciprocation of the plunger and movement of fuel from the supply line through the chamber to the corresponding cylinder. A spill valve is positioned between the chamber and the nozzle, the valve having a first position providing a maximum fuel injection rate, a second position providing a substantially zero fuel injection rate, and at least one intermediate position providing an intermediate fuel injection rate. The method includes the steps of pressurizing fuel fed to a fuel injector nozzle, partially opening a spill valve communicating with the fuel injector nozzle so that the fuel injector injects fuel into a corresponding engine cylinder at a first fuel injection rate for a predetermined first period of time during an engine fuel injection cycle, and fully opening the spill valve so that the fuel injector injects fuel into the corresponding engine cylinder at a second fuel injection rate for a remainder of the engine fuel injection cycle, wherein the first injection rate and the second injection rate shape a fuel flow rate of injected fuel.

20 Claims, 8 Drawing Sheets

| RPM | % LOAD | TEST 1B EUP CAM PHASING: 20 DEGS CAM @ 6 DAT EUP CAM PROFILE: RISING RATE | | | | | | | TEST 1C EUP CAM PHASING: 33 DEGS CAM @ 6 DAT EUP CAM PROFILE: FALLING RATE | | | | | | |
|---|---|---|---|---|---|---|---|---|---|---|---|---|---|---|---|
| | | BOI dbtc | ICR m/s | NEP bar | BsNOx g/hphr | BsPt total g/hphr | BsPt volatiles g/hphr | BsPt solids g/hphr | BOI dbtc | ICR m/s | NEP bar | BsNOx g/hphr | BsPt total g/hphr | BsPt volatiles g/hphr | BsPt solids g/hphr |
| 1800 | 90 | +2 | 1.55 | 1278 | 3.16 | 0.076 | 0.018 | 0.058 | -6 | 3.3 | 1430 | 3.62 | 0.049 | 0.012 | 0.037 |
| 1800 | 50 | +2 | 1.55 | 841 | 3.48 | 0.076 | 0.022 | 0.054 | -6 | 3.3 | 1293 | 4.19 | 0.029 | 0.016 | 0.013 |
| 1800 | 10 | +2 | 1.55 | 440 | 6.78 | 0.122 | 0.098 | 0.024 | 0 | 3.3 | 573 | 7.62 | 0.151 | 0.115 | 0.036 |
| 1513 | 90 | +2 | 1.55 | 1130 | 3.59 | 0.060 | 0.015 | 0.045 | -6 | 3.3 | 1169 | 3.99 | 0.044 | 0.010 | 0.034 |
| 1513 | 50 | +2 | 1.55 | 758 | 3.83 | 0.078 | 0.020 | 0.058 | -6 | 3.3 | 1019 | 4.30 | 0.030 | 0.013 | 0.017 |
| 1513 | 10 | +3 | 1.55 | 375 | 6.68 | 0.108 | 0.098 | 0.010 | +1 | 3.3 | 516 | 7.67 | 0.106 | 0.086 | 0.020 |
| 1168 | 90 | +2 | 1.55 | 805 | 3.84 | 0.078 | 0.017 | 0.061 | -6 | 3.3 | 857 | 4.32 | 0.059 | 0.011 | 0.048 |
| 1168 | 50 | +2 | 1.55 | 516 | 4.74 | 0.076 | 0.019 | 0.057 | -6 | 3.3 | 805 | 4.53 | 0.050 | 0.017 | 0.033 |
| 1168 | 10 | +3 | 1.55 | 336 | 7.39 | 0.118 | 0.118 | 0.000 | +1 | 3.3 | 469 | 8.56 | 0.119 | 0.111 | 0.008 |
| 650 | 25 | +4 | 1.55 | 295 | 10.8 | 0.060 | 0.060 | 0.000 | +2 | 3.3 | 342 | 10.90 | 0.050 | 0.050 | 0.000 |
| 650 | 0 | +4 | 1.55 | 265 | 468 | 18.3 | 17.6 | 0.7 | +3 | 3.3 | 314 | 712 | 11.6 | 10.7 | 0.9 |
| | | EST. TRANSIENTS | | | 4.20 | 0.083 | 0.026 | 0.057 | EST. TRANSIENTS | | | 4.67 | 0.051 | 0.023 | 0.028 |
| | | ACT. TRANSIENTS | | | 3.81 | 0.106 | 0.028 | 0.078 | ACT. TRANSIENTS | | | 4.56 | 0.068 | 0.031 | 0.037 |

FIG. 3A

| BsFc @ 100% LOAD | | |
|---|---|---|
| @ LISTED BsNOx LEVELS | TEST 1B | TEST 1C |
| 1800 rpm | 0.3723 | 0.3749 |
| 1600 rpm | 0.3459 | 0.3579 |
| 1400 rpm | 0.3413 | 0.3489 |
| 1250 rpm | 0.3394 | 0.3463 |
| @ CYLINDER PRESS LIMIT | | |
| 1800 rpm | 0.3483 | 0.3188 |
| 1600 rpm | 0.3329 | 0.3108 |
| 1400 rpm | 0.3263 | 0.3103 |
| 1250 rpm | 0.3249 | 0.3090 |

FIG. 3B

DIESEL ENGINE FUEL INJECTION SYSTEM

BACKGROUND OF THE INVENTION

1. Field of the Invention

The present invention relates generally to a diesel engine fuel injector system, and more particularly to an electronically controlled spill port for a fuel injector.

2. Description of the Background Art

Fuel injectors are devices used to meter out precise volumes of fuel into a cylinder of an engine. They are commonly used for purposes of precise fuel control, increased fuel economy, and emissions reduction. By accurately controlling the rate and volume of injected fuel and the time in the engine cycle when the fuel is injected, a fuel injector can be used to achieve the above goals.

The onset, rate, and duration of fuel injected into a diesel engine has been proven to affect BsNOx and BsPt emissions levels, as well as affecting BsFC. BsNOx is a measure of Brake specific Nitrogen Oxide emissions, such as NO and $NO_2$ pollutants. BsPt is a measure of Brake specific lead (Pt) emissions, another pollutant generated by an engine. BsFC is the Brake specific Fuel Consumption, which is a measure of fuel rate in pounds per hour divide by power output (lb/hp-hr).

A high cam velocity and high hydraulic flow nozzle (short injection durations) can provide minimum fuel consumption. However, with this aggressive injection system, injection timing cannot be retarded enough to meet U.S. 1998 BsNOx standards without misfire and a rapid increase in BsPt emissions levels. The reason for this is the high fuel injection rate associated with a high velocity cam and high hydraulic flow nozzle, as shown in the chart of FIG. 1A. It has been well documented that the fuel injection rate significantly impacts BsNOx emissions levels, especially the injection rate during the first 5–10 engine degrees of injection. As the injection rate increases, the BsNOx emissions levels also increase.

The effort to reduce emissions through more precise control of fuel injection has led to several related art approaches. One simple method uses a slower velocity cam and a lower hydraulic flow nozzle, as shown in the chart of FIG. 1B. This allows low BsNOx and BsPt emissions levels without retarding injection timing so much as to cause misfire. This system will, however, increase injection duration and will therefore impact highway fuel consumption.

Another more complicated method for allowing lower BsNOx emissions levels to be obtained with any injection system is to inject a small quantity of "pilot" fuel before the main injection (i.e., pilot injection). Pilot injection is depicted in the chart of FIG. 1C. This small pilot quantity of fuel does not reduce the rate of injection but will allow more retarded main injection timings without misfire, thus allowing lower BsNOx emission levels without a rapid increase in BsPt emissions levels. However, as main injection timing is retarded to control BsNOx, the BsPt solids emissions levels will gradually increase due to a later occurring end of injection. It is therefore possible that a system optimized for minimum fuel consumption (very high rate of injection) would require such retarded timings to meet U.S. 1998 BsNOx emissions standards that the BsPt emissions levels may exceed the 1998 targets, even if pilot injection is utilized. At any rate, very retarded injection timings can cause several other problems such as poor fuel consumption, high heat rejection, excessive turbo wheel speed and the requirement of a large timing range designed into the cam profile.

A further refinement of the precise control of fuel injection is the use of a spill valve. A spill valve allows the spilling of fuel from the injector during the injection cycle. Spill valves are used because fuel injectors are mechanical devices, driven off of a camshaft. A cylinder within the injector is driven by the cam, and provides a fuel volume and pressure as dictated by the timing and aggressiveness of the cam. The operation of the injector cylinder is mechanically fixed by the cam, and cannot be varied during operation of the engine. In order to more precisely control the fuel injection, such as by electronic means, a spill valve is used to discard some of the pressurized fuel. The spill valve can be opened at any time in the injection cycle (i.e., when the injector cylinder is pressurizing the fuel) to spill excess or unneeded fuel.

One approach is to have a spill valve designed into the plunger/barrel assembly of an injector. This approach is currently utilized by Navistar with the HEUI (PRIME) system and is illustrated in FIGS. 2A and 2B. The spill valve is fixed in location and spills a portion of the high pressure fuel during the initial part of an injection stroke, as can be seen in FIG. 2A. However, the HEUI (PRIME) system is a fixed spill valve which cannot vary the injection opening timing and flow rate in order to minimize emissions levels for a full range of engine loads.

Another approach in the related art is given in Cananagh, U.S. Pat. No. 5,333,588. Cananagh discloses a fuel injector having an electromagnetically controlled spill valve, and may include two such spill valves. Cananagh proposes two spill ports in order to cope with large displacements of fuel per injector plunger stroke. The purpose of dual spill valves in Cananagh is to increase the flow area through which fuel can escape from the injector pumping chamber. In addition, Cananagh discloses a non-synchronized opening of the spill valves where one valve can be energized slightly before the other to provide variation of the initial rate of delivery of fuel. This is apparently done to forestall a premature high fuel pressure at the inlet of the injection nozzle. If the fuel pressure exceeds a nozzle opening pressure, the injector nozzle may open prematurely. Apparently the goal of Cananagh in early closing of one spill valve is to delay the opening of the injector nozzle by forestalling a high fuel pressure.

What is needed therefore is a spill valve system wherein more than one fuel injection rate can be obtained in order to rate shape the fuel injection profile.

SUMMARY OF THE INVENTION

A diesel engine fuel injection system is provided according to a first aspect of the invention. The diesel engine fuel injection system comprises a fuel injector for injecting fuel into a corresponding engine cylinder, each fuel injector having a pump chamber, a fuel injecting plunger for reciprocating within the pump chamber, a supply line connected to the pump chamber for receiving fuel, and a discharge nozzle connected to the pump chamber and to the corresponding cylinder for injecting fuel into the corresponding cylinder, a cam shaft having a respective cam operably connected to the plunger of the corresponding fuel injector so that rotation of the cam causes reciprocation of the plunger and movement of fuel from the supply line through the chamber to the corresponding cylinder, and a spill valve positioned between the chamber and the nozzle for controlling a rate of fuel injection to the corresponding cylinder, the spill valve having a first position providing a maximum fuel injection rate, a second position providing a substantially zero fuel injection rate, and at least one intermediate position providing an intermediate fuel injection rate between the maximum fuel injection rate and the zero fuel injection rate.

A diesel engine fuel injection system is provided according to a second aspect of the invention. The diesel engine fuel injection system comprises a fuel injector for injecting fuel into a corresponding engine cylinder, each fuel injector having a pump chamber, a fuel injecting plunger for reciprocating within the pump chamber, a supply line connected to the pump chamber for receiving fuel, and a discharge nozzle connected to the pump chamber and to the corresponding cylinder for injecting fuel into the corresponding cylinder, a cam shaft having a respective cam operably connected to the plunger of the corresponding fuel injector so that rotation of the cam causes reciprocation of the plunger and movement of fuel from the supply line through the chamber to said corresponding cylinder, and at least two spill valves positioned between the chamber and the nozzle for controlling a rate of fuel injection to the corresponding cylinder, providing a maximum fuel injection rate when both of the at least two spill valves are open, providing a substantially zero fuel injection rate when both of the at least two spill valves are closed, and providing an intermediate fuel injection rate between the maximum fuel injection rate and the zero fuel injection rate when one of the at least two spill valves are open.

A method for rate shaping a fuel injecction profile in a diesel engine is provided according to a third aspect of the invention. The method comprises the steps of pressurizing fuel fed to a fuel injector nozzle, partially opening a spill valve communicating with the fuel injector nozzle, so that the fuel injector injects fuel into a corresponding engine cylinder at a first fuel injection rate for a predetermined first period of time during an engine fuel injection cycle, and fully opening the spill valve so that the fuel injector injects fuel into the corresponding engine cylinder at a second fuel injection rate for a remainder of the engine fuel injection cycle, wherein the first injection rate and the second injection rate shape a fuel flow rate of injected fuel.

The above and other objects, features and advantages of the present invention will be further understood from the following description of the preferred embodiment thereof, taken in conjunction with the accompanying drawings.

BRIEF DESCRIPTION OF THE DRAWINGS

FIGS. 3A and 3B show tables of emissions levels under different engine conditions, wherein B0I is beginning of injection, ICR is initial C-rate and NEP is nozzle end pressure, and wherein maximum NEP at rated speed is equal (1430 bar) for both tests;

DETAILED DESCRIPTION OF THE PREFERRED EMBODIMENTS

Figure 1A:
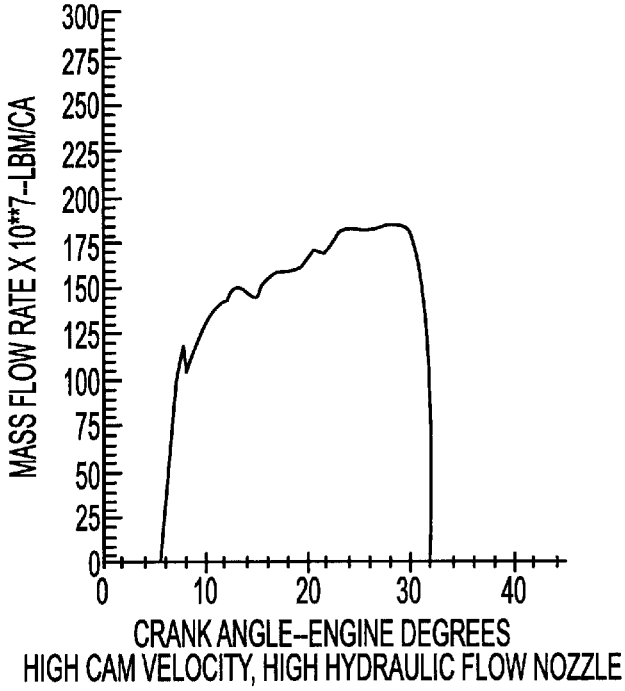
FIG. 1A (PRIOR ART)
FIGS. 1A–1D show charts illustrating fuel flow versus engine crank angle for different fuel injector systems.
Figure 1B:
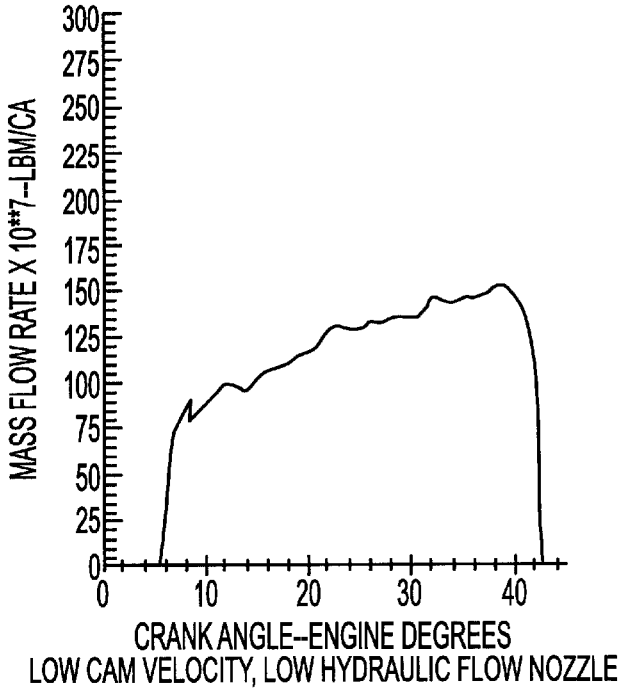
FIG. 1B (PRIOR ART)
Figure 1C:
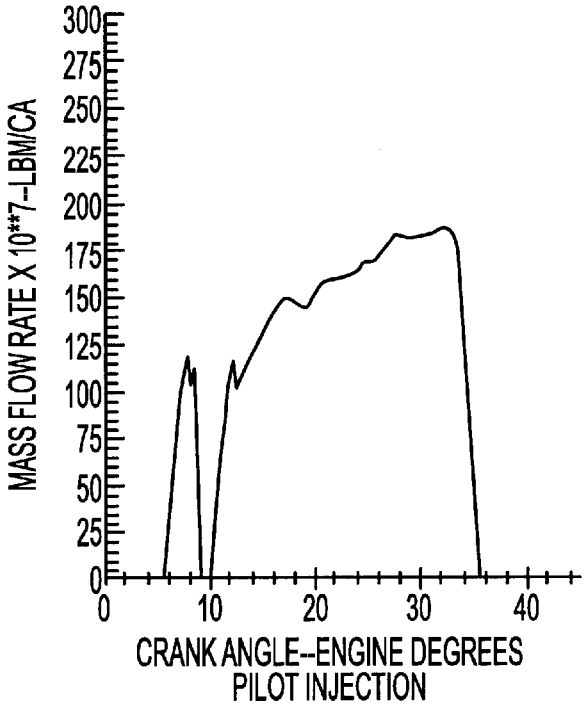
FIG. 1C (PRIOR ART)

FIGS. 3A and 3B show data which compares the effect of initial cam velocity or injection rate on BsNOx and BsPt emissions levels, as well as the effect on BsFC. As can be seen from the data of FIGS. 3A and 3B, if the initial cam velocity is reduced from 3.3 meters per second (m/s) to 1.55 m/s, BsNOx emissions levels are reduced at all speeds and loads, but BsPt emissions levels increase at 50% and 90% engine loads. The increase in BsPt emissions levels at 50% and 90% engine loads is primarily due to an increase in solids particulate emissions as a result of lower nozzle end pressure (NEP) at part loads associated with the lower initial cam velocity (ICR) at the same nozzle hydraulic flow. Although nozzle end pressure is lower at 10% engine loads with the 1.55 m/s initial cam velocity, the BsPt emissions levels do not increase. At 10% engine loads, the BsPt emissions levels are comprised mostly of volatile compounds, which are more dependent on injection timing than on nozzle end pressure.

Test 1B of FIGS. 3A and 3B (initial cam velocity=1.55 m/s) produced transient BsNOx emissions levels 16% lower than test 1C, even though injection timing was 8 degrees more advanced in test 1B than in test 1C. Also, test 1B produced lower NOx limited fuel consumption levels than in test 1C, possibly as a result of the more advanced end of the injection cycle in test 1B. The increased injection durations of test 1B did, however, increase cylinder pressure limited fuel consumption. The cylinder pressure limited fuel consumption levels were particularly poor in test 1B due to the rising rate cam profile. As injection timing was advanced towards peak cylinder pressure limits, initial cam velocity continued to reduce, therefore target peak cylinder pressure limits could not be obtained at all speeds.

By examining the data of FIGS. 3A and 3B, several conclusions can be made regarding the effect an injection system can bring to emissions levels and fuel consumption. For minimum cylinder pressure limited fuel consumption, a high velocity cam and high hydraulic flow nozzle are required. For low BsNOx emissions levels a low rate of injection (first 5 to 10 crank degrees) is required so that injection timing can be advanced enough to prevent misfire. A low rate of injection also optimizes the BsNOx-fuel consumption tradeoff. The rate of injection at any time during the injection event is function of nozzle end pressure, cam velocity, and nozzle hydraulic flow. Although BsPt emissions levels at 10% engine loads are not greatly dependent on nozzle end pressure, for low BsPt emissions levels at increased engine loads (50–100%) a high average nozzle end pressure is required, thus reducing the solids particulate emissions fractions. Therefore, an optimal injection system would utilize a high hydraulic flow nozzle and a low velocity cam for the first 5–10 crank degrees of fuel injection to allow low BsNOx emissions. In the optimal injection system, the cam velocity would then quickly increase to obtain high average nozzle end pressure at 50–100% loads. However, at peak cylinder pressure limits, the cam must be at a high velocity for the entire injection duration, otherwise injection duration would be increased and fuel consumption would be degraded.

Figure 4B:
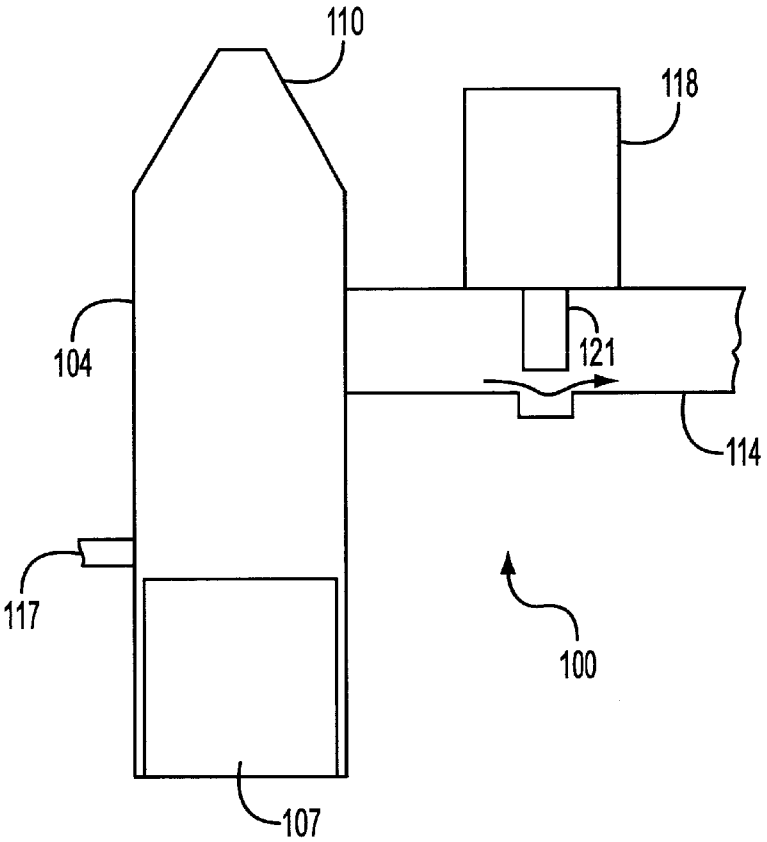
FIGS. 4A–4C are diagrams of a three-position spill valve of the present invention in three different positions.
Figure 4A:
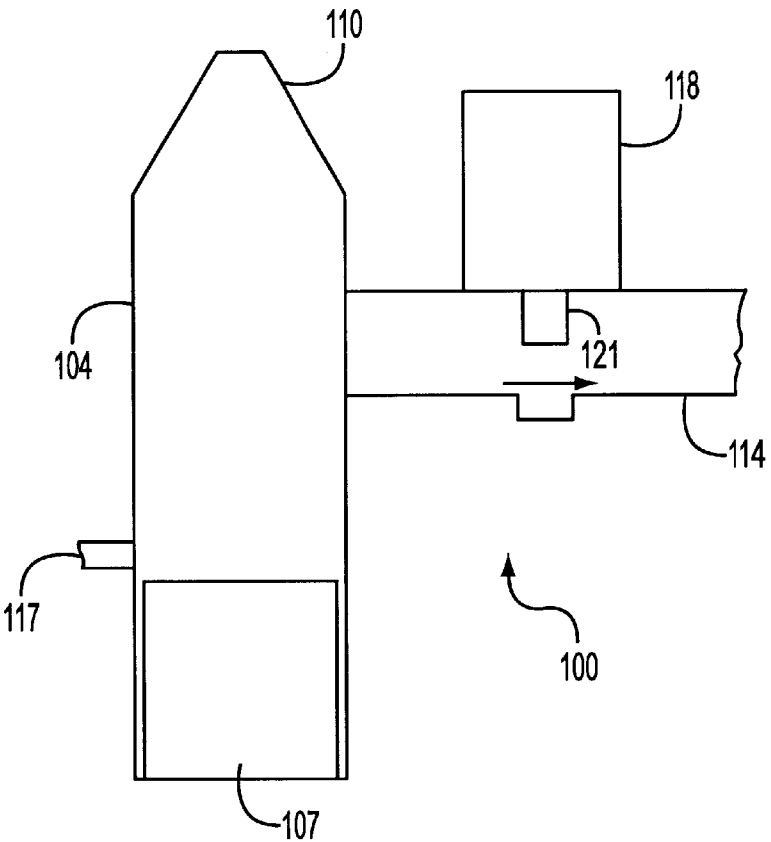
Figure 4C:
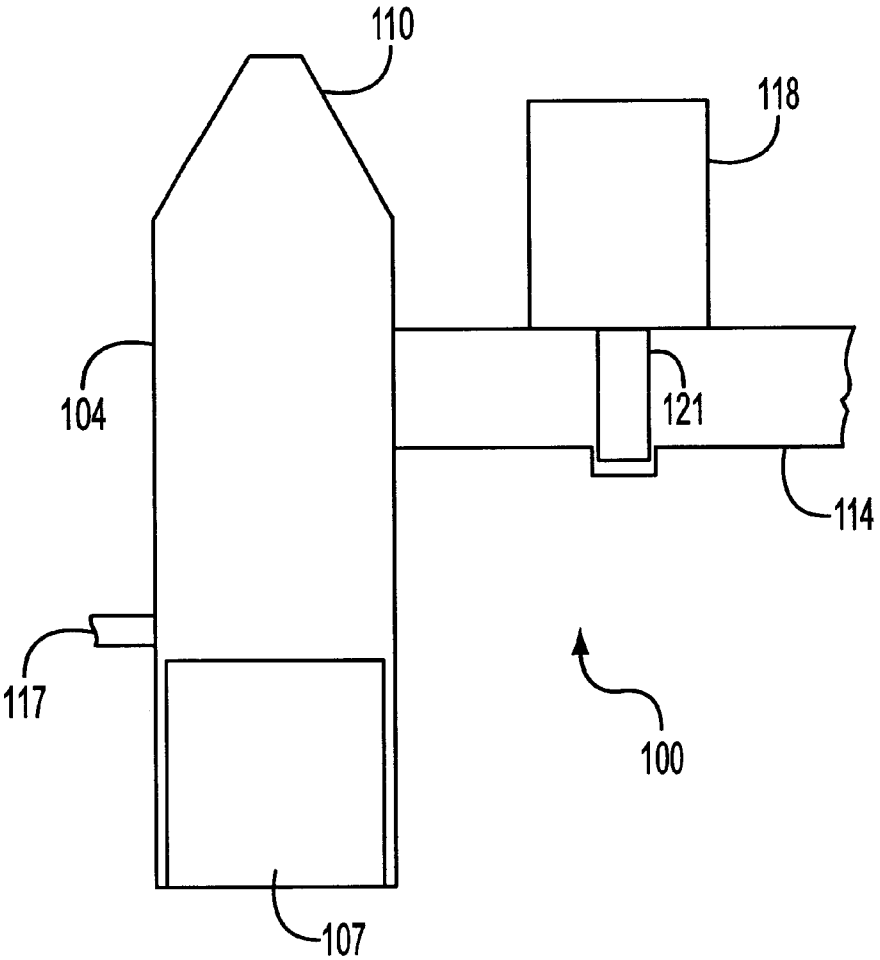

Referring now to FIGS. 4A–4C, there is shown a first embodiment of the fuel injection system 100 of the present invention. The fuel injection system 100 includes an injector 104 having a plunger 107 and a nozzle 110, a fuel return line 114, a fuel supply line 117, and a spill valve 118 having a spill valve plunger 121.

In operation, fuel is fed to the fuel injector 104 by the fuel supply line 117. The plunger 107 pressurizes the fuel, and the spill valve 118 controls the spilling of fuel above the injector plunger 107. The spill valve 118 shown in FIGS. 4A–4C is a three-position type of valve. The three positions are when the spill valve plunger 121 is open (FIG. 4A), when the spill valve plunger 121 is partially closed (FIG.

4B), and when the spill valve plunger 121 is fully closed (FIG. 4C). When the spill valve 118 is completely open, fuel is spilled at a rapid rate, and no increase in the fuel pressure occurs. When the spill valve 118 is partially closed, the fuel above the plunger 107 is pressurized, but due to the slight spilling action the spilling effectively reduces the cam velocity. When the spill valve 118 is completely closed, the fuel is completely pressurized and the nozzle 110 opens.

This spilling action may be electronically controlled, and may occur, for example, during the first (and critical) five to ten crank degrees of fuel injection. This is especially important for urban operation. It should be appreciated, however, that the electronically controlled spilling action may be performed at any time, and it is not strictly confined to the first five to ten crank degrees of fuel injection.

As indicated by the data of FIGS. 3A and 3B, this spilling action would improve low BsNOx emissions capability and improve the BsNOx-BsFC relationship. The spilling effect would not be utilized at peak cylinder pressure limits so that the full benefit of a high velocity cam may be realized.

The effective reduction in cam velocity would be dependent on the spill area offered by the configuration of the spill valve 118. The duration of the spilling action would be dependent on the reaction capability of the spill valve 118 (i.e., how quickly the valve may be opened or closed). In the preferred embodiment, the three position spill valve 118 must be capable of moving to the partially closed position and dwelling at this position for approximately one millisecond before completely closing.

Although the preferred embodiment above discloses the use of a solenoid-type valve, it is contemplated that a magnetic latching valve may optionally be used. In addition, although a three-position spill valve is disclosed in the preferred embodiment, alternatively a spill valve may be used having more than three positions in order to provide an even more finely controlled flow of fuel.

Figure 1D:
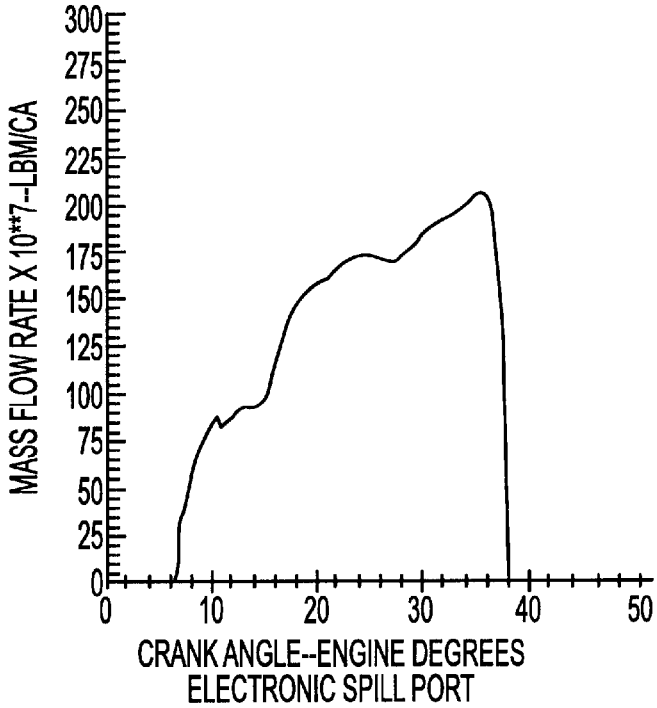
Figure 2A:
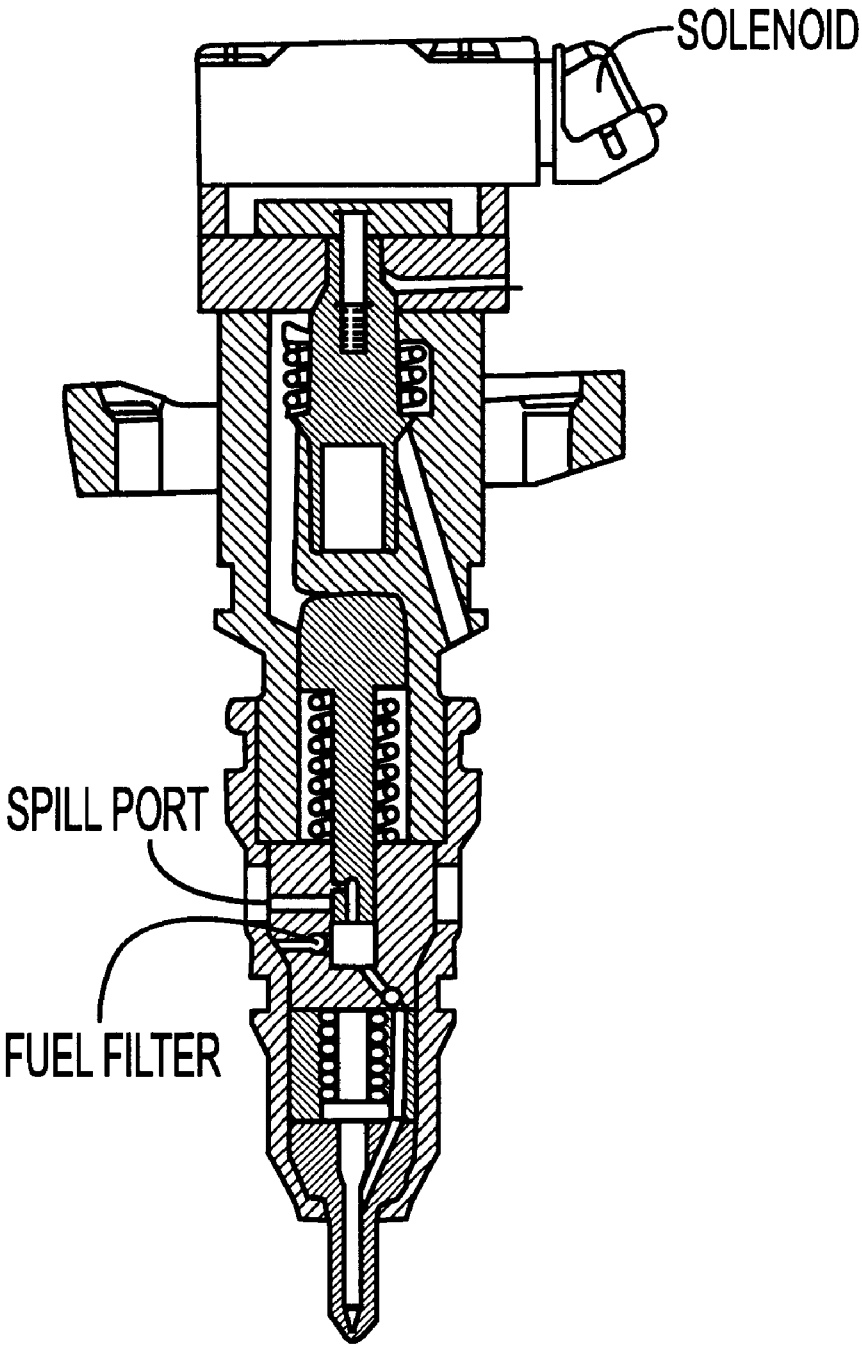
FIG. 2A (PRIOR ART)
FIGS. 2A–2B show a prior art fuel injector system and related fuel flow characteristics.
Figure 2B:
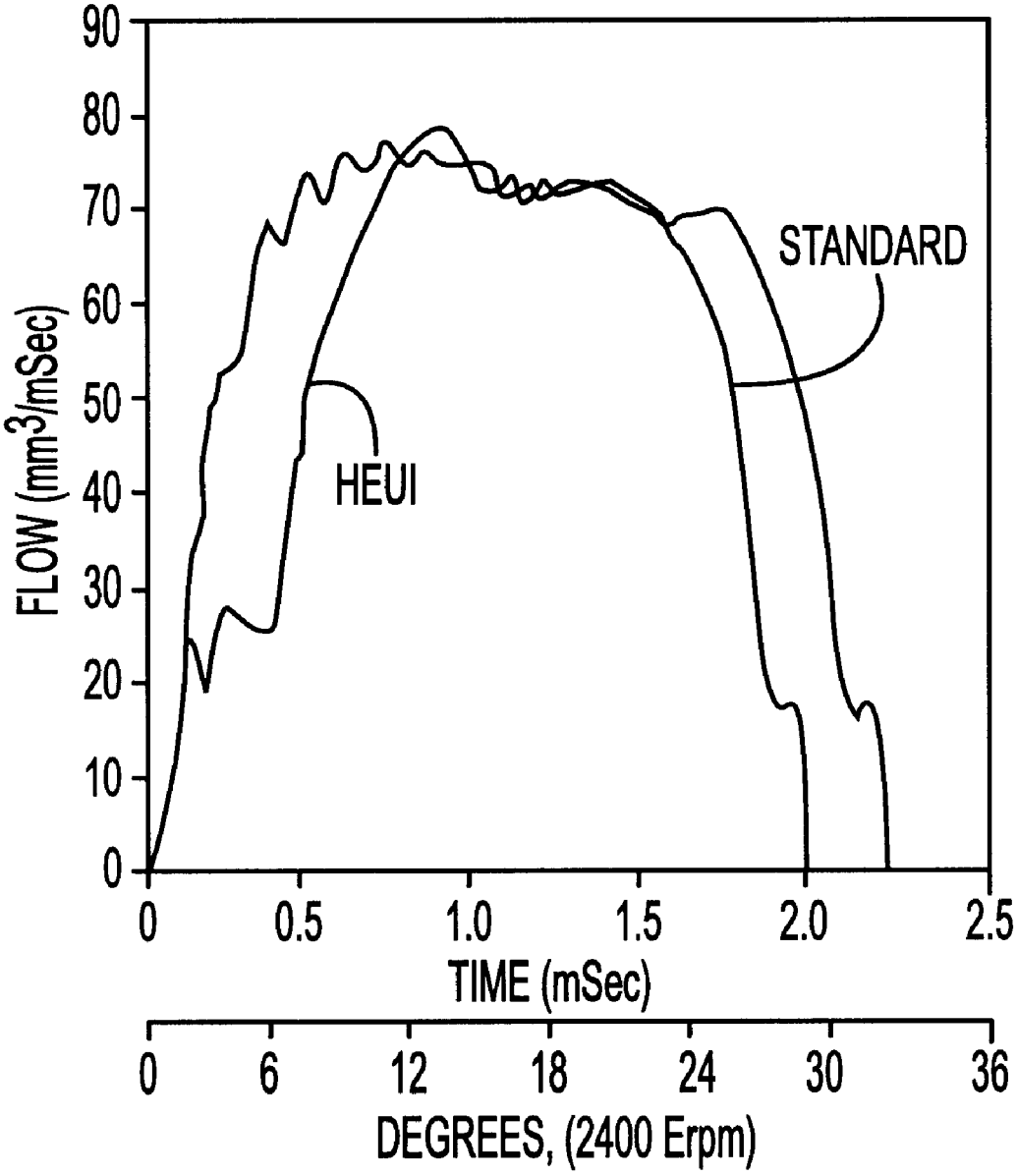
FIG. 2B (PRIOR ART)

The overall effect of the above invention is the capability to control the onset, rate and volumetric flow of injected fuel (e.g., rate shaping of the injected fuel). The rate shaped fuel flow is shown in FIG. 1D, where for the crank angle of approximately five to ten degrees the fuel flow rate is at a low level, and after that the fuel flow rate is comparable to the high cam velocity, high hydraulic flow fuel flow rate of FIG. 1A. Other considerations are the ease of control by electronic means, such as an engine control processor, simplicity of the design, ease of retrofitting, and reliability.

Figure 5:
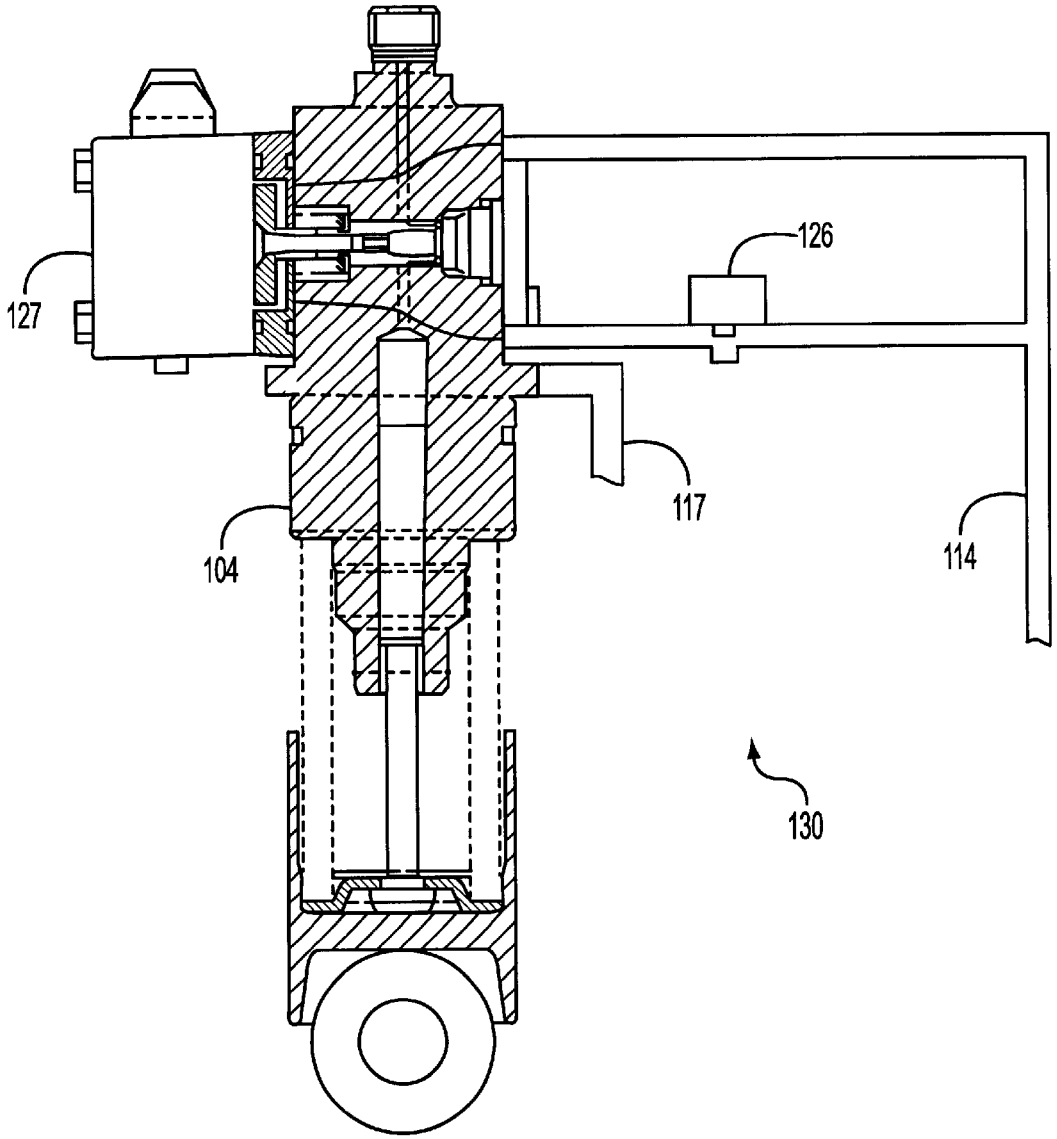
FIG. 5 is a diagram of a fuel injector system incorporating two two-position spill valves to acheive the objectives of the present invention.

An alternative approach is a second embodiment 130, shown in FIG. 5. The second embodiment 130 includes an identical injector body 104 having identical components as revealed above. In this alternative embodiment, two or more two-position spill valves 126 and 127 are substituted for the single three-position spill valve 118. Upon closing the primary spill valve 127, fuel may still be spilled through the secondary spill valve 126 and into the fuel return line 114. The duration of the spilling action and the shape of the fuel flow rate may be electronically controlled by independently closing the spill valves 126 and 127. Alternatively, more than two two-position spill valves may be used in order to provide an even more finely controlled flow of fuel.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A diesel engine fuel injection system, comprising:

a fuel injector for injecting fuel into a corresponding engine cylinder, each fuel injector having a pump chamber, a fuel injecting plunger for reciprocating within said pump chamber, a supply line connected to said pump chamber for receiving fuel, and a discharge nozzle connected to said pump chamber and to said corresponding cylinder for injecting fuel into said corresponding cylinder;

a cam shaft having a respective cam operably connected to said plunger of said corresponding fuel injector so that rotation of said cam causes reciprocation of said plunger and movement of fuel from said supply line through said chamber to said corresponding cylinder; and a spill valve positioned between said chamber and said nozzle for controlling a rate of fuel injection to said corresponding cylinder, said spill valve having a first position providing a maximum fuel injection rate, a second position providing a substantially zero fuel injection rate, and at least one intermediate position providing an intermediate fuel injection rate between said maximum fuel injection rate and said zero fuel injection rate.

2. The injection system of claim 1, wherein said intermediate fuel injection rate is used for an initial fuel injection phase and said maximum fuel injection rate is used for a main fuel injection phase.

3. The injection system of claim 1, wherein two of said spill valves are used, with said zero fuel injection rate occurring when both of said two spill valves are open, said intermediate injection rate occurring when one said spill valve is open and one said spill valve is closed, and said maximum fuel injection rate occurring when both of said two spill valves are closed.

4. The injection system of claim 1, wherein a spill valve actuation is controlled electronically, and can occur at any time in an engine cycle.

5. The injection system of claim 1, wherein said spill valve is actuated by a solenoid.

6. The injection system of claim 1, wherein said spill valve is a magnetic-latching spill valve.

7. The injection system of claim 1, wherein said spill valve is capable of dwelling at said intermediate position for about one millisecond.

8. The injection system of claim 1, wherein said spill valve is capable of attaining said at least one intermediate position during a first five to ten crank degrees of fuel injection.

9. A method for rate shaping a fuel injection profile in a diesel engine, comprising the steps of:

pressurizing fuel fed to a fuel injector nozzle;

partially opening a spill valve communicating with said fuel injector nozzle, so that said fuel injector injects fuel into a corresponding engine cylinder at a first fuel injection rate for a predetermined first period of time during an engine fuel injection cycle; and fully opening said spill valve so that said fuel injector injects fuel into said corresponding engine cylinder at a second fuel injection rate for a remainder of said engine fuel injection cycle;

wherein said first injection rate and said second injection rate shape a fuel flow rate of injected fuel.

10. The rate shaping method of claim 9, wherein said first fuel injection rate is an intermediate fuel injection rate and said second fuel injection rate is a maximum fuel injection rate.

11. The rate shaping method of claim 9, wherein said method allows the use of a higher velocity pump driving a fuel pressure and a high hydraulic flow nozzle.

12. The rate shaping method of claim 9, wherein said first fuel injection rate occurs during a first five to ten crank degrees of fuel injection.

13. The rate shaping method of claim 9, wherein said first fuel injection rate is used.

14. The rate shaping method of claim 9, wherein said first fuel injection rate is not used at peak cylinder pressure limited timings.

15. A diesel engine fuel injection system, comprising:

a fuel injector for injecting fuel into a corresponding engine cylinder, each fuel injector having a pump chamber, a fuel injecting plunger for reciprocating within said pump chamber, a supply line connected to said pump chamber for receiving fuel, and a discharge nozzle connected to said pump chamber and to said corresponding cylinder for injecting fuel into said corresponding cylinder;

a cam shaft having a respective cam operably connected to said plunger of said corresponding fuel injector so that rotation of said cam causes reciprocation of said plunger and movement of fuel from said supply line through said chamber to said corresponding cylinder; and a spill valve configuration selected from the group consisting of:

a) a spill valve positioned between said chamber and said nozzle for controlling a rate of fuel injection to said corresponding cylinder, said spill valve having a first position providing a maximum fuel injection rate, a second position providing a substantially zero fuel injection rate, and at least one intermediate position providing an intermediate fuel injection rate between said maximum fuel injection rate and said zero fuel injection rate; and b) at least two spill valves positioned between said chamber and said nozzle for controlling a rate of fuel injection to said corresponding cylinder, providing a maximum fuel injection rate when both of said at least two spill valves are closed, providing a substantially zero fuel injection rate when both of said at least two spill valves are open, and providing an intermediate fuel injection rate between said maximum fuel injection rate and said zero fuel injection rate when one of said at least two spill valves are open.

16. The injection system of claim 15, wherein said intermediate fuel injection rate is used for an initial fuel injection phase and said maximum fuel injection rate is used for a main fuel injection phase.

17. The injection system of claim 15, wherein actuation of said at least two spill valves is controlled electronically, and can occur at any time in an engine cycle.

18. The injection system of claim 15, wherein said at least two spill valves are actuated by solenoids.

19. The injection system of claim 15, wherein said at least two spill valves are magnetic-latching valves.

20. The injection system of claim 15, wherein said spill valve is capable of attaining said at least one intermediate position during a first five to ten crank degrees of fuel injection.

* * * * *